United States Patent [19]

Gent

[11] 4,028,067

[45] June 7, 1977

[54] PROCESS FOR PRODUCING COMBUSTIBLE GASES

[75] Inventor: Colin William Gent, Stockton-on-Tees, England

[73] Assignee: Imperial Chemical Industries Limited, London, England

[22] Filed: June 3, 1975

[21] Appl. No.: 583,292

[30] Foreign Application Priority Data

June 10, 1974 United Kingdom ..... 25639/74

[52] U.S. Cl. ..... 48/197 R; 48/214 A; 260/449 M

[51] Int. Cl.[2] ..... C10G 11/28

[58] Field of Search ..... 48/197 R, 214 A; 260/449 M

[56] References Cited

UNITED STATES PATENTS

| | | | |
|---|---|---|---|
| 3,511,624 | 5/1970 | Humphries et al. | 260/449 M |
| 3,515,514 | 6/1970 | Holmes et al. | 48/197 R |
| 3,642,460 | 2/1972 | Thompson | 260/449 M |
| 3,650,713 | 3/1972 | Chinchen et al. | 48/214 A |
| 3,898,057 | 8/1975 | Moller et al. | 48/197 R |
| 3,915,670 | 10/1975 | Lacey et al. | 48/197 R |

FOREIGN PATENTS OR APPLICATIONS

| | | | |
|---|---|---|---|
| 792,914 | 4/1958 | United Kingdom | 48/197 R |
| 798,741 | 7/1958 | United Kingdom | 48/197 R |

*Primary Examiner*—Robert L. Lindsay, Jr.
*Assistant Examiner*—George C. Yeung
*Attorney, Agent, or Firm*—Cushman, Darby & Cushman

[57] ABSTRACT

A process for producing a substitute natural gas from methanol, especially seaborne methanol liable to be contaminated with chloride, comprises catalytically reacting methanol vapor in a decomposition stage at an outlet temperature above 550° C, cooling the resulting gas by indirect heat exchange, preferably with water, to 250°–350° C, methanating the cooled gas with an outlet temperature of 500°–650° C, cooling the methanated gas by indirect heat exchange, preferably with methanol, and methanating the resulting gas in at least one further methanation stage. By avoiding the injection of liquid methanol, as had been previously proposed, for cooling the hot gas, the poisoning of catalysts by impurities such as chloride does not take place.

4 Claims, 1 Drawing Figure

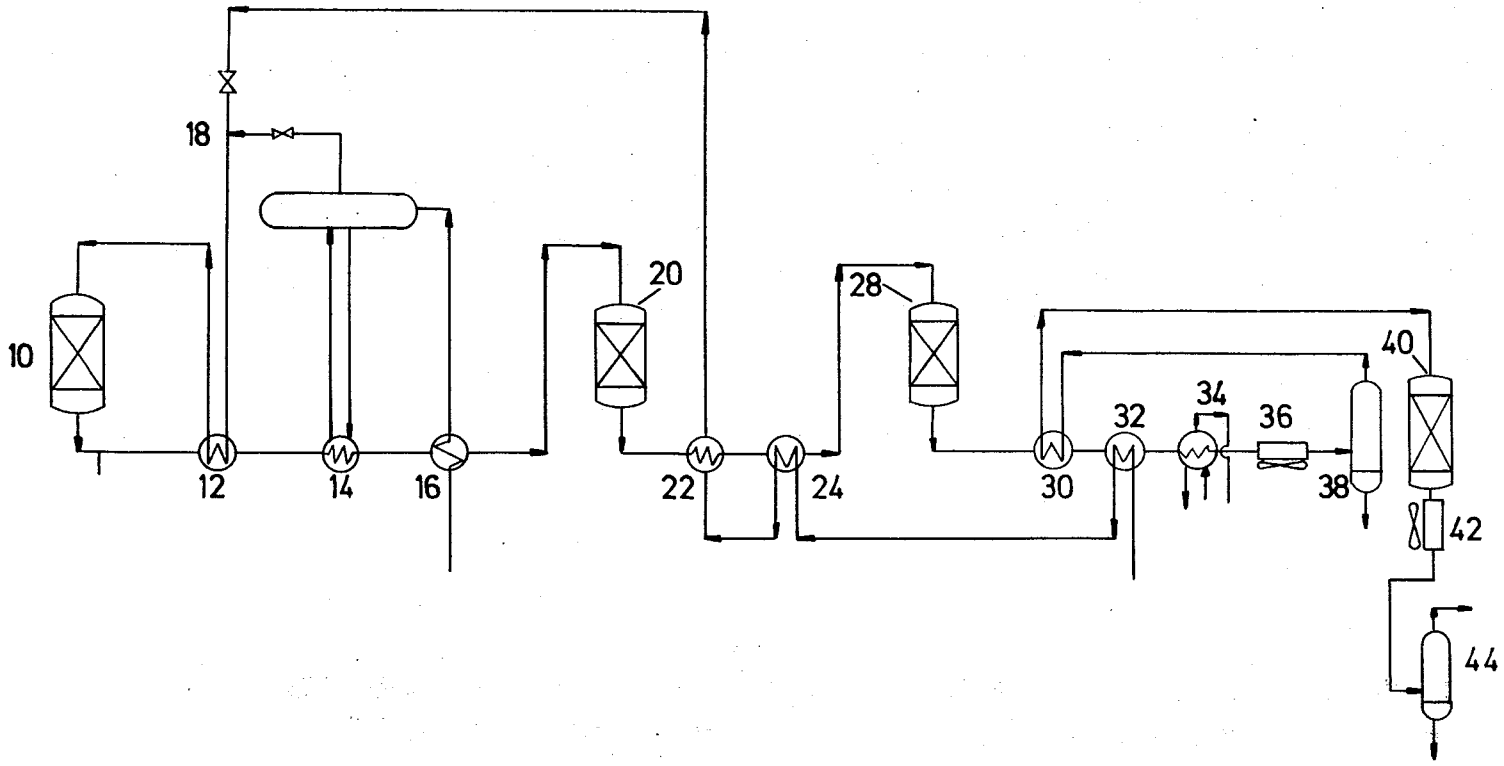
10
12
14
16
18
20
22
24
28
30
32
34
36
38
40
42
44

PROCESS FOR PRODUCING COMBUSTIBLE GASES

THIS INVENTION RELATES to combustible gases and in particular to a process of making a substitute natural gas by catalytic reaction of methanol.

In U.S. application Ser. No. 528,852 and U.K. application 13109/73 there is described a process for converting methanol to a natural gas substitute or gas adjustable thereto by gas-phase catalytic reaction at a temperature controlled by heat exchange with liquid methanol and/or water. An embodiment of this process involves injection of liquid methanol and/or water at intervals along the catalyst bed used. The feed to the bed preferably comprises hydrogen and/or carbon monoxide and these can be provided by a preliminary stage in which a portion of the methanol and steam are reacted together adiabatically in conditions such that a gas of relatively low methane content results. The remainder of the methanol and steam feed is then injected into that gas. This process has a disadvantage if the methanol feed is impure, for example if it has been transported by sea and become contaminated with chloride, namely that it affords no opportunity for removal of impurities; as a result the impurities will reach the catalyst and poison it.

We have now realised that the process can be conducted by reacting all the methanol in conditions similar to those in the preliminary bed and methanating the product leaving the preliminary bed with temperature control by indirect heat exchange. The new process involves reactor outlet temperatures such that highly efficient heat recoveries are achievable.

According to the invention a substitute natural gas is produced by a process that comprises reacting methanol vapour in a decomposition stage under substantially adiabatic conditions with an outlet temperature above 550° C over a refractory catalyst having steam reforming and methanation activity, cooling the resulting decomposition gas by indirect heat exchange to a temperature in the range 250° –350° C, methanating the resulting cooled gas in a first methanation stage under substantially adiabatic conditions with an outlet temperature in the range 500° –650° C, cooling the resulting first methanation stage gas by indirect heat exchange and methanating the cooled gas in at least one further methanation stage.

The further methanation can be in one wet stage or in one dry stage or in a wet stage followed by a dry stage, depending on how great a portion of methane is present after the first methanation stage and what proportion of hydrogen and/or carbon monoxide can be tolerated in the final product gas. Usually more than two such stages are not needed. A dry stage can be before or after carbon dioxide removal. If desired, the hydrogen content of the gas can be decreased by adding a hydrocarbon of higher molecular weight than methane, for example a normally gaseous hydrocarbon such as liquefied petroleum gas or "natural gas liquid" and passing the mixture over a methanation catalyst, possible in one of the further methanation stages, possibly in an extra stage.

A final adjustment of calorific value can be made by adding liquefied petroleum gas or "natural gas liquid."

The outlet temperature of the decomposition stage is typically in the range 600° –900° C. The required temperature can be achieved by using a catalyst of high methanation activity and preheating the reactants to a relatively low temperature such as one in the range 250° –500° C. This is the preferred way of operating the decomposition step, but it is also possible to use a catalyst of low methanation activity in conjunction with a preheating temperature above 500° C. The methane content of the decomposition gas is preferably under 35% by volume on a dry basis.

The catalyst of high methanation activity evidently must have substantial activity both below 500° C and above 600° C, that is, both in the "rich gas" temperature range and in the "tubular steam reforming" range, respectively. A number of catalysts are usable for this purpose, containing one or more metals from Group VIII of the Periodic Table, in particular nickel and/or cobalt along or with one or more platinum group metals, or platinum group metals especially ruthenium, on refractory supports. Especially suitable catalysts contain nickel and/or cobalt and alumina. The metal content of catalysts containing nickel and/or cobalt is preferably in the range 25–90%, especially 40–85%, by weight expressed as metal oxide on the non-volatile content of the oxide precursor from which the catalyst is made by reduction. The refractory support can have been introduced into the catalyst all by coprecipitation or, as broadly described in our U.S. Pat. No. 3,507,811, partly by co-precipitation and partly as a solid powder.

The outlet temperature of the first methanation stage is normally lower than that of the decomposition stage and is typically in the range 550° –600° C. Such temperatures are at the upper end of what is normally considered suitable for methanation, and therefore the catalysts described in the preceding paragraph are preferably used. The first methanation stage is suitably controlled to produce a gas containing over 40%, for example 50–60%, by volume of methane on a dry basis.

The inlet and outlet temperatures of any further methanation stages are lower and consequently known methanation catalysts, for example co-precipitated nickel/alumina or cobalt/alumina give acceptable results.

The process is operated suitably at a pressure in the range 1–120 atmospheres absolute, especially 5–100 ata. These are outlet pressures after carbon dioxide removal and final cooling and drying of product gas. The inlet pressures are typically 10–25 ata greater, the difference depending on such factors as the size of the catalyst pellets and the length to diameter ratio of the catalyst beds.

The molar ratio of steam to methanol taking part in the reaction should be sufficient to avoid the formation of free carbon and is suitably in the range 0.3 to 2.0. Most conveniently all the steam and methanol are fed to the decomposition stage.

The reactors used for the various stages can be simple cylindrical vessels. The decomposition and first methanation reactors are suitably lined with refractory concrete in order to avoid over-heating their walls and surrounded by water jackets to maintain their walls in compression about the refractory lining. The volume of catalyst used in each reactor should be such that when the process is started up equilibrium is reached before the outlet of the bed, in order to allow for the slow deactivation that normally takes place.

The process may be operated with the aid of conventional expedients, such as recycle streams and quenching injections of methanol or water as vapour or (less preferably, because of the risk of contamination) liquid, but it is an advantage of the invention that these can be wholly or substantially avoided. Very conveniently, when a mixture of steam and methanol is fed to the decomposition stage, the steam is produced by cooling the decomposition gas and the methanol vapour is produced by cooling the first methanation stage gas. The reaction of methanol to give methane produces carbon dioxide and water as by-products. Either or both of these can be returned to the methanol supplier to be reacted with the hydrocarbon feedstock, such as natural gas, used in making methanol synthesis gas, or recovered and used in any other way. The water by-product is conveniently at over 100° C and can thus be efficiently used in district heating, thus affording a valuable energy recovery.

The accompanying drawing shows a schematic flowsheet of one preferred form of the process of the invention.

Item 10 is the decomposition reactor, in which is disposed a fixed bed of supported nickel catalyst. Downstream of it are disposed feed preheater 12, then steam boiler 14 and boiler feed water heater 16. The feed to 16 is from steam condensation stages further downstream, by way of a de-gasser which is conventional and therefore are not shown on the flowsheet. The hot water from heater 16 is boiled in 14, mixed with methanol vapour at 18 and fed to reactor 10. Downstream of boiler feed water heater 16 is disposed first methanator 20, which is followed by methanol boiler 22 and methanol feed heater 24 and then by second methanator 28, which in turn is followed by three heat exchangers 30, 32 and 35 and cooler 36. Of these three heat exchangers, 30 is a feed preheater for the dry methanator to be described, 32 is a liquid methaol preheater and 34 is a reboiler for the carbon dioxide removal section (not shown) of the plant. It will be noted that methanol preheater 32, methanol feed heater 24 and methanol boiler 22 are operated in series. Boiler 22 is constructed so as to avoid entrainment of chloride-containing spray by the methanol vapour produced. Cooler 36 is followed by catchpot 38, the liquid run-off from which leads to users of hot water, such as a district heating scheme and, so far as the process requires water feed, to the de-gasser already mentioned; the gas outlet leads via preheater 30 to dry methanator 40. Then follows cooler 42 and catchpot 44, the liquid run-off of which leads to the de-gasser mentioned above the gas outlet of which leads to a carbon dioxide removal section and final cooler, catchpot and drier, which are conventional and therefore not shown.

It it is not necessary to decrease the hydrogen and carbon monoxide contents to a very low level, dry methanator 38 can be omitted. Its preheater 30 is then unnecessary and the heat taken out of the product gas of second methanator 28 can be recovered in any other convenient way. The gas leaving catchpot 38, in this simplified form of the process, passes directly to the carbon dioxide removal section.

The process as shown uses no external source of heat. If it is desired to make it independent of external sources of methanical power, steam can be raised in boiler 14 at such a pressure - for example 100 ata - that it can drive a turbine passing out steam at a pressure suitably above that required at point 18.

EXAMPLE

Methanol at the rate of 3277 kilogram-moles per hour (105 metric tons per hour) is heated under pressure in preheater 32 and vaporised in boiler 22 to give vapour at 215° C, 50 ata pressure. At point 18 steam at 265° C, 50 ata pressure, at the rate of 1638.5 kg moles/hour (29.5 metric tons/hour) is mixed with the methanol vapour. The mixture is preheated at 12 to 450° C (pressure now 44.5 ata) and fed to reactor 10, which contains a catalyst consisting of metallic nickel (56% w/was NiO) and alumina, the alumina being partly introduced by coprecipitation with nickel carbonate partly as alpha alumina trihydrate. Methanol decomposition and methanation take place giving a product gas at 734° C, which is then cooled in feed preheater 12 to 540° C, in steam boiler 14 to 342° C and boiler feed water heater 16 to 285° C, the inlet temperature of first methanator 20, charged with catalyst similar to that in reactor 10.

In 20 further methanation takes place, the temperature of the product gas being 583° C. This gas is cooled in methanol boiler 22 to 386° C, then in methanol feed heater 24 to 285° C, the inlet temperature of second methanator 28, also charged with catalyst similar to that in reactor 10. In 28 still further methanation takes place, but the content of carbon oxides and hydrogen is initially relatively low and the content of unreactive gases -steam, methane and excess carbon dioxide - is relatively high, and therefore the temperature rise is much lower than in reactor 20. The outlet gas, at 407° C is cooled to 307° C in dry methanator feed preheater 30, to 203° C in liquid methanol preheater 32, to 168° C in condensate re-boiler 34 and finally to 135° C in cooler 36. At 135° C water condenses and is separated in catchpot 38. The dried gas is preheated at 30 to 300° C and passed to dry methanator 40, charged with catalyst similar to that in reactor 10, in which methanation takes place and the temperature rises to 338° C. The outlet gas is cooled at 42 to 80° C, at which water condenses and is separated in catchpot 44. The dried gas is then subjected to carbon dioxide removal and final drying and, if required, adjustment of calorific value by addition of liquefied petroleum gas.

The stream composition at various reaction stages are as shown in the Table. It is evident that the gas leaving second methanator 28 would, after removal of steam and carbon dioxide, be a substitute natural gas for undertakings applying less rigorous specifications for hydrogen, carbon monoxide and higher hydrocarbons.

Table

| Stage | Flow-sheet item no. | Composition vol. percent | | | | |
|---|---|---|---|---|---|---|
| | | CO | $CO_2$ | $H_2$ | $CH_4$ | $H_2O$ |
| Decomposer outlet | 10 | 7.10 | 11.63 | 26.13 | 22.96 | 32.18 |
| First methanator outlet | 20 | 1.34 | 13.59 | 11.62 | 31.83 | 41.62 |
| Second methanator outlet | 28 | 0.06 | 12.92 | 2.49 | 36.39 | 48.15 |
| Dry methanator inlet | 40 | 0.11 | 22.94 | 4.42 | 64.63 | 7.90 |
| Dry methanator outlet | 40 | 0.05 | 22.45 | 0.48 | 66.97 | 10.04 |
| Catchpot outlet | 44 | 0.05 | 24.64 | 0.53 | 73.50 | 1.27 |
| Final | | | | | | |

Table-continued

| Stage | Flow-sheet item no. | Composition vol. percent | | | | |
|---|---|---|---|---|---|---|
| | | CO | $CO_2$ | $H_2$ | $CH_4$ | $H_2O$ |
| product after $CO_2$-removal and drying | — | 0.07 | 0.50 | 0.71 | 98.72 | 0.0 |

I claim:

1. A process for producing a substitute natural gas which consists essentially of reacting methanol vapour in a decomposition stage, wherein the feed to the decomposition stage contains steam and the molar ratio of steam to methanol is in the range of 0.3 to 2.0, under substantially adiabatic conditions with an outlet temperature of at least 600° C over a refractory catalyst having steam reforming and methanation activity, cooling the resulting gas by indirect heat exchange to a temperature in the range 250° –350° C, methanating the resulting cooled gas in a first catalytic methanation stage with an outlet temperature in the range 500° –650° C, cooling the resulting first catalytic methanation stage gas by indirect heat exchange and methanating the cooled gas in at least one further catalytic methanation stage, said refractory catalyst containing nickel, cobalt or mixtures thereof on a refractory support, the content of nickel, cobalt or mixtures thereof being in the range 40–85% by weight as metal oxide on the non-volatile content of the oxide precursor from which the catalyst is made by reduction, the refractory support having been introduced into the catalyst partly by coprecipitation and partly as solid powder.

2. A process according to claim 1 in which the outlet temperature of the decomposition stage is in the range 600° –900° C.

3. A process according to claim 1 in which the catalyst used in the decomposition has high methanation activity and the steam and methanol mixture entering that stage is preheated to a temperature in the range 250° –500° C.

4. A process according to claim 1 in which steam is produced by indirect heat exchange between liquid water and the gas leaving the decomposition stage and methanol vapour is produced by indirect heat exchange between liquid methanol and the gas leaving the first catalytic methanation stage.

* * * * *